US005437400A

United States Patent [19]

Loeffler

[11] Patent Number: 5,437,400

[45] Date of Patent: Aug. 1, 1995

[54] CAN POUR SYSTEM

[76] Inventor: Paul L. Loeffler, 1508 Monroe Dr., Edgewater, Fla. 32132

[21] Appl. No.: 265,125

[22] Filed: Jun. 24, 1994

[51] Int. Cl.[6] ..... B65D 25/40

[52] U.S. Cl. ..... 222/570; 366/343

[58] Field of Search ..... 222/156, 541, 570; 366/342, 343, 605; 416/213 A

[56] References Cited

U.S. PATENT DOCUMENTS

| | | | |
|---|---|---|---|
| 2,673,077 | 6/1952 | Messbauer | 416/185 |
| 2,733,900 | 2/1956 | Wobensmith | 366/605 |
| 2,804,988 | 9/1957 | Dobbins, 3rd | 222/570 |
| 2,839,229 | 6/1958 | Scheswohl | 222/570 |
| 2,896,925 | 7/1959 | Place | 366/605 |
| 2,918,264 | 12/1959 | Ackles | 416/184 |
| 3,372,832 | 6/1966 | Yeater et al. | 220/254 |
| 3,972,512 | 8/1976 | Grise et al. | 366/605 |
| 4,050,678 | 9/1977 | Smith | 366/130 |
| 4,125,210 | 11/1978 | Embree | 222/570 |
| 4,422,770 | 12/1983 | Geible | 366/248 |
| 4,472,063 | 9/1984 | Eichelmann | 366/605 |
| 4,538,922 | 9/1985 | Johnson | 366/605 |
| 4,651,885 | 3/1987 | Gach | 222/541 |
| 4,673,099 | 6/1987 | Wells | 220/269 |
| 4,949,865 | 8/1990 | Turner | 220/335 |
| 5,115,951 | 5/1992 | Leslie et al. | 222/570 |
| 5,251,979 | 10/1993 | Larsen | 366/248 |

FOREIGN PATENT DOCUMENTS

| | | | |
|---|---|---|---|
| 2117658 | 10/1983 | United Kingdom | 366/343 |

*Primary Examiner*—Andres Kashnikow
*Assistant Examiner*—Philippe Derakshani
*Attorney, Agent, or Firm*—Paul S. Rooy

[57] ABSTRACT

A can pour system comprising a can, a lid, a cap and an agitator. The lid comprises a lid tongue sized to frictionally mate with a can female groove, and a lid spout having a spout aperture and a spout male thread. The cap comprises a cap female thread sized to mate with the spout male thread. The agitator comprises an agitator shank and an agitator wing.

4 Claims, 3 Drawing Sheets

CAN POUR SYSTEM

BACKGROUND OF THE INVENTION

1. Field of the Invention

This invention relates to can closures, and in particular to a can pour system.

2. Background of the Invention

Many types of paint are sold in concentrated form, and require the addition of paint thinner prior to use. In some applications, other agents such as hardener, activators and fisheye remover must be mixed into the paint along with the thinner before use. These different liquids are typically packaged in cans (generally of quart, 1-gallon, or 5-gallon capacity) having a can female groove around a circular top can opening. These cans are closed by means of a tongued can lid, whose tongue is frictionally pushed into the top can groove to seal the contents inside the can.

The current method of mixing the various liquids is to pour the correct proportions of the various paints, thinner, hardener, activator, etc. into a mixing can, and then manually mix them together with a wooden paddle. The resulting paint mix is then poured from the mixing can into a paint gun reservoir, paint roller trough, etc., for application.

One problem associated with this method of mixing and paint dispensing is the paint tends to remain within the paint can female groove after paint has been poured out of a can. Then when the lid tongue is frictionally pushed into the can female groove, the liquid in the can female groove tends to be displaced out of the can female groove and over the side of the can, and could run down the side of the can onto the floor below. If the paint is difficult to clean, this displaced paint could cause permanent stains on the surface upon which the can rests, and creates additional work in the form of cleanup. A more serious problem is that the presence of paint, thinner, hardener, etc. on the outside of the can may create a health hazard if the can is handled without gloves.

In addition, the liquid remaining in the can groove may harden, thereby rendering the can top/can seal pervious to air, which could allow the contents of the can to dry out and spoil. This would cause waste of materials (some types of paint are extremely expensive) and money.

EXISTING DESIGNS

FIG. 1 illustrates an existing flip-top pouring lid design 2. Flip-top pouring lid base 10 snaps onto paint can 4 as indicated by arrows 6. Flip-top pouring lid cover 8 is hingedly attached to flip-top pouring lid base 10 and can seal onto flip-top pouring lid base 10 to seal the contents of paint can 4. When flip-top pouring lid cover 8 is in the open position as depicted in FIG. 1, paint can be poured into paint can 4 through large aperture 12 and dispensed from paint can 4 through small aperture 14.

Problems associated with this design include the possibility of spillage if paint can 4 overturns, a relatively complex, hinged design, and increased material cost associated with that design complexity. In addition, if paint can 4 tips onto its side, or is shaken in transit, paint will coat the inside of flip-top pouting lid cover 8. When flip-top pouring lid cover 8 is subsequently opened, the paint adhering to it will tend to drip down the side of paint can 4, making a mess and wasting material. Still another problem associated with this design is the difficulty of stirring the contents of paint can 4 due to the constricted size of large aperture 12.

A number of patents have been granted for container lids comprising smaller pour apertures with caps. U.S. Pat. Nos. 4,949,865 and 3,372,832 were granted to Turner and Yeater et al. respectively for can closures featuring snap-on smaller caps. These inventions suffer from the disadvantage that the underside of the snap caps can carry paint from the inside of the can to the outside of the top cover when the snap cap is opened. This creates a mess and wasted material. In addition, the snap top may come open if the paint can is tipped open, thereby allowing the contents of the paint can to spill.

Embree was granted U.S. Pat. No. 4,125,210 for a paint can cover with an integral removable, small snap-fit cover. Problems associated with this design include the possibility that the-snap fit cover will fall out if the paint can to which it is attached tips over, and the probability that paint may drip off the snap-fit cover onto whatever surface it rests on when removed.

SUMMARY OF THE INVENTION

Accordingly, it is an object of the present invention to provide a can pour system capable of securely sealing the contents of a can. Design features allowing this object to be accomplished include a lid having a lid tongue, a lid spout with a spout male thread, and a cap comprising a cap female thread. Advantages associated with the accomplishment of this object include less chance of spillage if the can tips over, along with associated savings in paint and cleanup costs.

It is another object of the present invention to provide a can pour system which prevents the can contents from pooling in the can female groove. Design features allowing this object to be accomplished include a lid spout having a spout male thread, and a cap with cap female thread. Benefits associated with the accomplishment of this object include reduced cleanup time and enhanced worker safety, because unhealthy skin contact with spilled paint and paint cleaner is minimized.

It is another object of this invention to provide a can pour system which provides for easy stirring of the contents of the can. Design features enabling the accomplishment of this object include an agitator comprising an agitator wing attached to an agitator shank. An advantage associated with the realization of this object is that liquids (such as paint, thinner, hardener, activators, etc.) contained in a can may be quickly and effortlessly mixed, thereby reducing labor time and cost.

It is still another object of this invention to provide a can pour system whose design is simple. Benefits associated with reaching this objective include reduced cost and enhanced affordability to the user.

BRIEF DESCRIPTION OF THE DRAWINGS

The invention, together with the other objects, features, aspects and advantages thereof will be clearly more understood from the following in conjunction with the accompanying drawings.

Three sheets of drawings are provided. Sheet one contains FIG. 1. Sheet two contains FIG. 2. Sheet three contains FIGS. 3 and 4.

DETAILED DESCRIPTION OF THE PREFERRED EMBODIMENT

Figure 1:
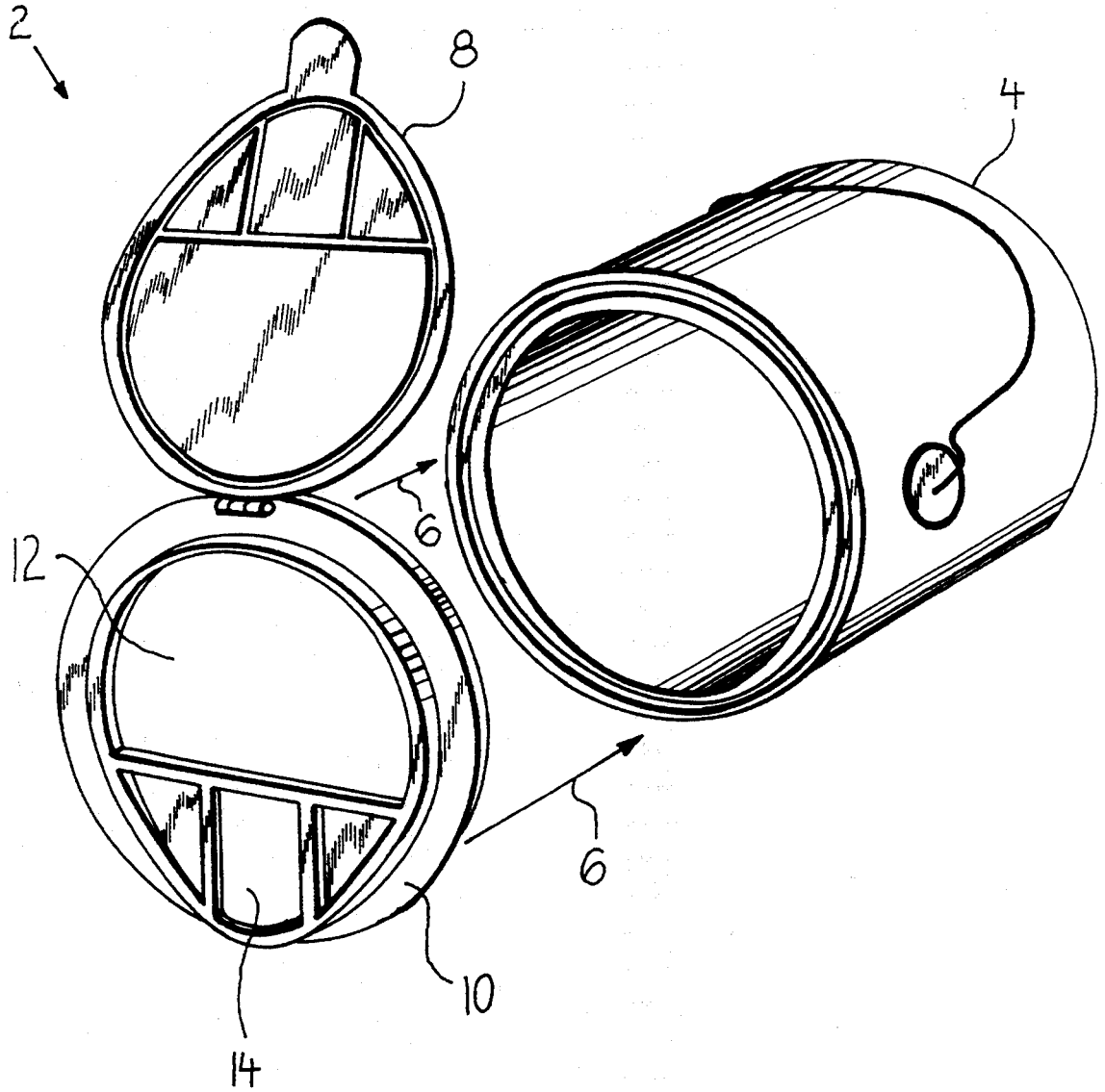
FIG 1 Prior Art
FIG. 1 is a from isometric views of an existing flip-top pouring lid design.
Figure 2:
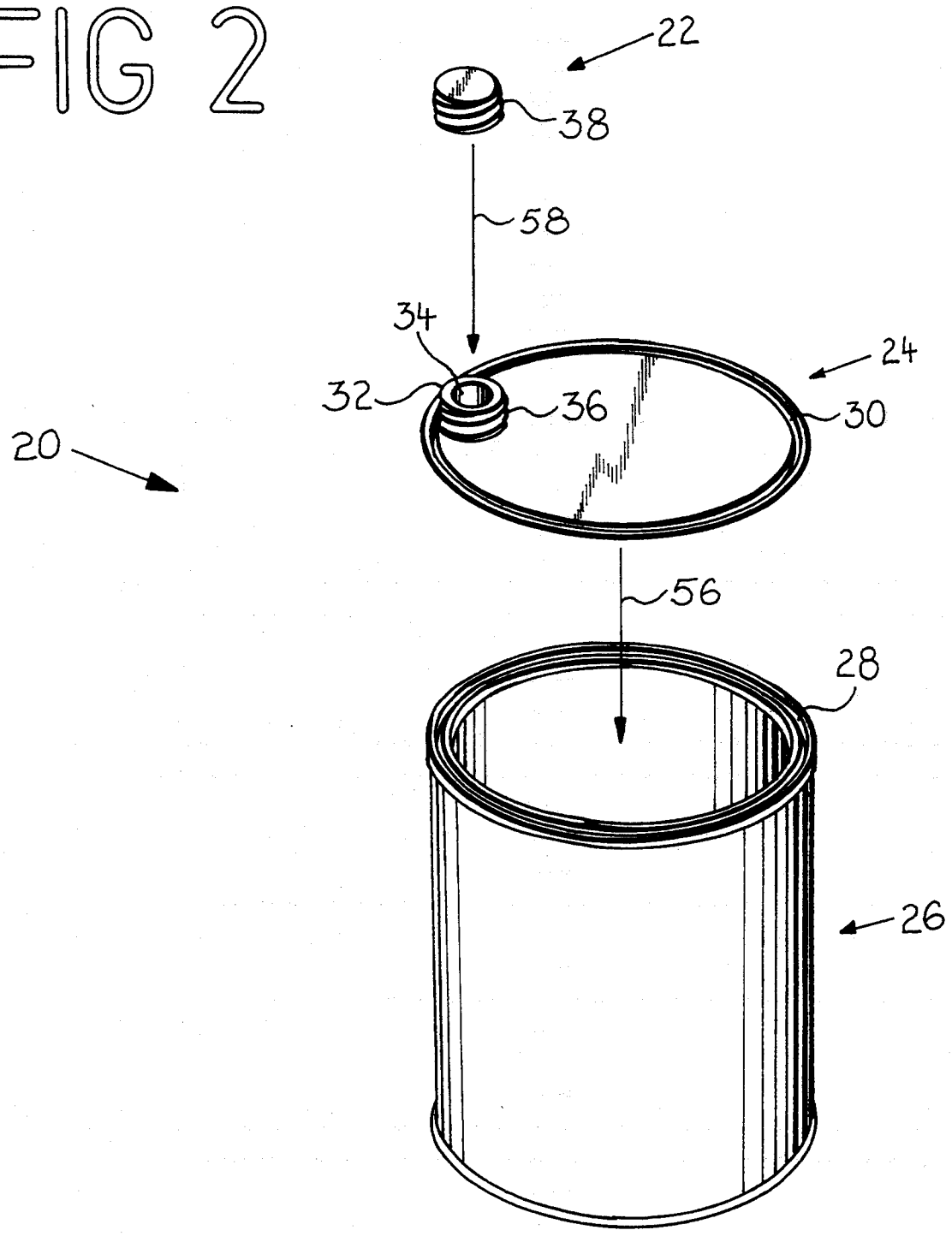
FIG. 2 is a front isometric view of a can, lid and cap.

FIG. 2 is a front isometric view of a can pour system 20 comprising can 26, lid 24 and cap 22. Can 26 is a standard can, such as a 1 gallon or 5 gallon paint can. Can 26 comprises can female groove 28.

Lid 24 comprises circumferentially disposed lid tongue 30 and lid spout 32 disposed close to an edge of lid 24. Lid tongue 30 is sized to frictionally mate with can female groove 28. whereby lid 24 may be removably installed on can 26 as indicated by arrow 56. Lid spout 32 is comprised of spout aperture 34 and spout male thread 36.

Cap 22 comprises cap female thread 38. Cap female thread 38 is sized to mate with spout male thread 36, whereby cap 22 may be removably screwed onto lid 24 as indicated by arrow 58.

Figure 3:
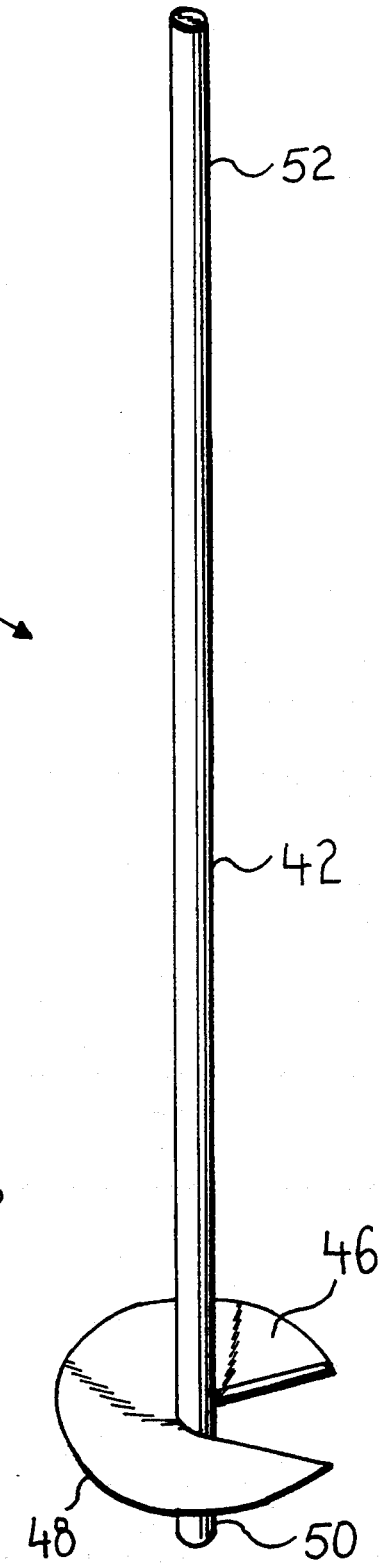
FIG. 3 is a front isometric view of an agitator.

FIG. 3 is a front isometric view of agitator 40. Agitator 40 comprises agitator wing 46 rigidly attached to agitator shank 42. Agitator shank 42 has agitator shank drill chuck end 52 at one extreme and agitator lower shank 50 at an opposite extreme. Agitator shank drill chuck end 52 is sized to be gripped by a standard drill chuck. Agitator wing 46 comprising agitator wing outer edge 48 is attached to agitator lower shank 50. When viewed from agitator shank drill chuck end 52, agitator wing outer edge 48 describes a departing counter-clockwise helix about agitator shank 42. Agitator wing 46 and agitator shank 42 are sized to freely fit through spout aperture 34. Agitator lower shank 50 extends away from agitator shank drill chuck end 52 beyond agitator wing 46 sufficiently to prevent agitator wing 46 from touching a surface perpendicular to agitator lower shank 50, upon which agitator lower shank 50 rests.

Cap 22, lid 24, can 26 and agitator may be fabricated of steel, metal, synthetic, or other appropriate material. Cap 22 may be a childproof cap, or partially transparent so the contents of can 26 may be visually inspected without removing cap 22 from lid 24.

Operation: Using Can 24 as a Dispenser

Press lid tongue 30 firmly into can female groove 28, thereby sealing lid 24 onto can 26. Firmly thread cap female thread 38 onto spout male thread 36. The contents of can 26 are now securely contained within can 26, safe from spilling even if can 26 were to tip over or become completely inverted. To dispense the contents of can 26, unscrew cap 22 from lid 24 and dispense through spout aperture 34.

Operation: Using Can 24 as a Mixing Vessel

Figure 4:
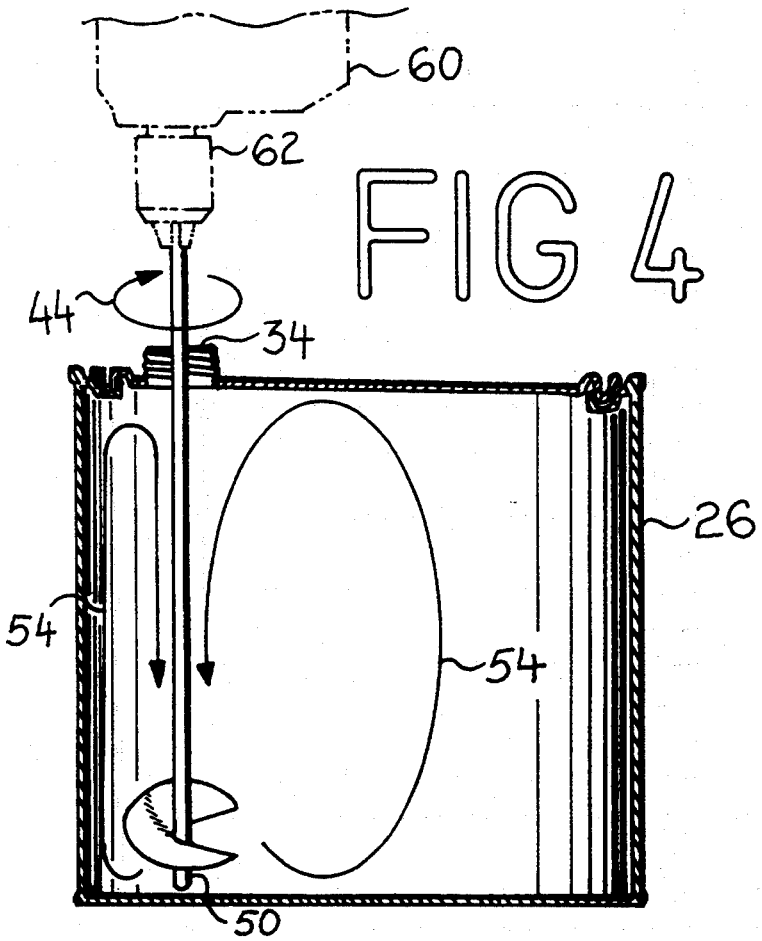
FIG. 4 is a side cross-sectional view of an agitator being used with a drill to mix the contents of can 26.

Pour the liquids to be mixed (i.e. various paints, thinner, hardener, activator, etc.) into can 26. Press lid tongue 30 firmly into can female groove 28, thereby sealing lid 24 onto can 26. Secure agitator shank drill chuck end 52 within a drill chuck 62. Introduce agitator lower shank 50 into can 26 through spout aperture 34 as indicated in FIG. 4. Use drill 60 to rotate agitator 40 as indicated by rotational arrow 44. Due to the shape of agitator wing 46 (when viewed from agitator shank drill chuck end 52, agitator wing outer edge 48 describes a counter-clockwise helix departing from agitator shank drill chuck end 52 about agitator lower shank 50), the liquids inside can 26 will be urged along a toroidal path as shown by liquid path arrows 54. Thus urged, the various liquids contained in can 26 (paints, thinner, hardener, activator, etc.) will become quickly and thoroughly mixed, thereby effortlessly producing a liquid mixture ready for use. The mixture may be hermetically stored within can 26 by screwing cap 22 onto lid spout 32, and dispensed as described in "Operation: Using Can 24 as a Dispenser", supra.

While a preferred embodiment of the invention has been illustrated herein, it is to be understood that changes and variations may be made by those skilled in the an without departing from the spirit of the appending claims.

DRAWING ITEM INDEX 2 flip-top pouring lid
4 paint can
6 arrow
8 flip-top pouring lid cover
10 flip-top pouting lid base
12 large aperture
14 small aperture
20 can pour system
22 cap
24 lid
26 can
28 can female groove
30 lid tongue
32 lid spout
34 spout aperture
36 spout male thread
38 cap female thread
40 agitator
42 agitator shank
44 rotational arrow
46 agitator wing
48 agitator wing outer edge
50 agitator lower shank
52 agitator shank drill chuck end
54 liquid path arrow
56 arrow
58 arrow
60 drill
62 drill chuck

I claim:

1. A can pour system comprising:

a lid comprising a lid tongue and a lid spout, said lid spout comprising a spout aperture and a spout male thread;

a cap comprising a cap female thread sized to mate with said spout male thread;

an agitator, said agitator comprising an agitator wing having an inner helical edge attached to an agitator lower shank at one end of an agitator shank, and an agitator shank drill chuck end at another end of said agitator shank, said agitator wing and said agitator shank being sized to freely fit through said spout aperture;

an agitator wing outer edge on said agitator wing, said agitator wing outer edge describing a counter-clockwise helix departing from said agitator shank drill chuck end about said agitator lower shank, when viewed from said agitator shank drill chuck end.

2. The can pour system of claim 1 wherein said agitator lower shank extends away from said agitator shank drill chuck end beyond said agitator wing sufficiently to prevent said agitator wing from touching a surface perpendicular to said agitator lower shank, upon which said agitator lower shank rests.

3. The can pour system of claim 1 further comprising a can having a can female groove, said lid tongue being sized to frictionally mate with said can female groove, said spout aperture communicating with an inside of said can.

4. The can pour system of claim 1 wherein said agitator shank drill chuck end is sized to be gripped by a standard drill chuck.

* * * * *